US007607569B2

(12) United States Patent
Van Rossum

(10) Patent No.: US 7,607,569 B2
(45) Date of Patent: Oct. 27, 2009

(54) LOCKING MAILBOX

(76) Inventor: Jack Van Rossum, 18460 Mecca, Hesperia, CA (US) 92345

( * ) Notice: Subject to any disclaimer, the term of this patent is extended or adjusted under 35 U.S.C. 154(b) by 99 days.

(21) Appl. No.: 11/695,798

(22) Filed: Apr. 3, 2007

(65) Prior Publication Data

US 2007/0228135 A1 Oct. 4, 2007

Related U.S. Application Data

(60) Provisional application No. 60/788,682, filed on Apr. 3, 2006.

(51) Int. Cl.
*B65G 11/04* (2006.01)

(52) U.S. Cl. ..... 232/48; 232/20; 232/27; 232/33; 232/45

(58) Field of Classification Search ..... 232/48, 232/47, 45, 33, 17, 20, 27
See application file for complete search history.

(56) References Cited

U.S. PATENT DOCUMENTS

| | | | | |
|---|---|---|---|---|
| 3,735,919 | A | 5/1973 | Morgan | |
| 3,802,619 | A | 4/1974 | Vanderveer | |
| 4,724,999 | A | 2/1988 | Fitzgerald et al. | |
| 4,753,386 | A * | 6/1988 | Phillion, Sr. | 232/43.1 |
| 5,148,974 | A | 9/1992 | Clapper | |
| 5,435,484 | A | 7/1995 | Carlson | |
| 5,526,979 | A | 6/1996 | Mann | |
| 5,645,215 | A * | 7/1997 | Marendt et al. | 232/17 |
| 6,588,656 | B2 * | 7/2003 | Cox et al. | 232/47 |
| 6,719,195 | B2 * | 4/2004 | Farentinos | 232/45 |
| 7,036,719 | B1 * | 5/2006 | Helphrey et al. | 232/47 |
| 7,249,705 | B2 * | 7/2007 | Dudley | 232/47 |
| 2002/0066779 | A1 | 6/2002 | Hassan | |
| 2003/0024973 | A1 | 2/2003 | Cox et al. | |
| 2004/0026492 | A1 | 2/2004 | Farentinos | |
| 2004/0195304 | A1 | 10/2004 | Kujawa et al. | |
| 2004/0238615 | A1 | 12/2004 | Offenbacher | |
| 2005/0006451 | A1 | 1/2005 | Taylor | |
| 2005/0258226 | A1 | 11/2005 | Kujawa et al. | |

* cited by examiner

*Primary Examiner*—William L. Miller
(74) *Attorney, Agent, or Firm*—Sheldon Mak Rose & Anderson PC; Marc A. Karish

(57) ABSTRACT

A securable storage container comprising: a hollow housing having a front wall, a back wall, side walls, a top and a bottom for defining a first compartment and a second compartment; a first door rotatably connected to the housing and providing access to the first compartment, the first door being reversibly movable between an open position and a closed position; a second door rotatably connected to the housing and providing access to the second compartment, the second door being lockable to the housing; two opposing trap doors, each trap door being rotatably coupled to one of the side walls of the housing for dividing the first compartment from the second compartment; and a deployment means for moving the trap doors between a closed position in which the first compartment is separated from the second compartment and an open position in which the first compartment is in communication with the second compartment; wherein opening the first door forces the deployment means to move the trap doors to the closed position; and closing the first door forces the deployment means to move the trap doors to the open position.

17 Claims, 7 Drawing Sheets

LOCKING MAILBOX

CROSS-REFERENCE TO RELATED APPLICATIONS

The present application claims priority from U.S. Provisional Patent Application No. 60/788,682, filed on Apr. 3, 2006, the entire contents of which are hereby incorporated herein by reference.

BACKGROUND

The present invention is directed to lockable storage containers and, more particularly to a lockable mailbox.

Throughout the world, mail is commonly delivered to a mailbox. A basic mailbox is a box or cylinder shaped container, sealed on all sides with a door in the front. The mailbox is normally mounted on a pole, post or other object, and is sized in accordance with postal service guidelines.

Mailboxes are designed to give mail carriers easy access to the inside of the mailbox so that mail can be quickly and easily deposited inside. The mail then sits in the box until the mail recipient comes and removes it from the mailbox. Often, such as in rural areas, delivered mail sits in the mailbox for extended periods of time until it is retrieved. During this time, the mail is accessible by anyone who wishes to view, tamper with, or steal it. The problem of mail tampering and theft is being exacerbated by increased purchasing over the Internet and the associated shipping of goods to mailboxes.

There is a need for a lockable mailbox that allows for easy mail delivery and secure mail storage that solves the shortcomings of the prior art.

SUMMARY

Accordingly, the present invention is directed to a securable storage container comprising: a hollow housing having a front wall, a back wall, side walls, a top and a bottom for defining a first compartment and a second compartment. A first door rotatably connected to the housing provides access to the first compartment. The first door is reversibly movable between an open position and a closed position.

A second door rotatably connected to the housing provides access to the second compartment. The second door is lockable to the housing. The container has two opposing trap doors for dividing the first compartment from the second compartment, each trap door being rotatably coupled to one of the side walls of the housing.

Additionally, the container has a deployment means for moving the trap doors between a closed position in which the first compartment is separated from the second compartment and an open position in which the first compartment is in communication with the second compartment. Opening the first door forces the deployment means to move the trap doors to the closed position; and closing the first door forces the deployment means to move the trap doors to the open position.

In a preferred embodiment, the trap doors each have a slot; and the deployment means comprises: a lever rotatably coupled to the first door; and a support bracket rotatably coupled to the lever and rotatably coupled to at least one of the side walls or the bottom. At least a portion of the bracket is positioned in the slots of the trap doors. The slots are configured such that movement of the support bracket along the slots causes the trap doors to be reversibly moveable from the open position to the closed position.

Optionally, the container has a stop coupled to the front wall or the rear wall to limit the range of movement of the trap doors. The second door may have a key lock or a combination lock. Additionally, the container may have an indicator for indicating the presence of outgoing mail in the container. The container may also have at least one clip on an inside of the first door for holding outgoing mail.

Optionally, the container has a brace for attaching the container to a support structure, the brace being coupled to the housing. Optionally, the top is peaked and extends beyond the front wall.

In an additional embodiment, the container has: an outgoing mail pocket extending horizontally along one of the side walls; a first trap door rotatably coupled to the outgoing mail pocket; and a second trap door rotatably coupled to the side wall opposite the outgoing mail pocket. Additionally, the trap doors may have rounded edges that contact the side walls when the trap doors reach the closed position to limit the range of movement of the trap doors. Optionally, the second compartment is larger than the first compartment and is sized such that the entire volume of the first compartment can fit in the second compartment without contacting the deployment means.

In an additional embodiment, the present invention is also directed to a securable storage container having a hollow housing defining a first compartment and a second compartment. A first door rotatably connected to the housing provides access to the first compartment, the first door being reversibly movable between an open position and a closed position. A second door rotatably connected to the housing provides access to the second compartment, the second door being lockable to the housing.

The container has two opposing trap doors, each trap door being rotatably coupled to an inside of the housing for dividing the first compartment from the second compartment. Additionally, the container has a deployment means for moving the trap doors between a closed position, in which the first compartment is separated from the second compartment, and an open position in which the first compartment is in communication with the second compartment. Opening the first door causes the deployment means to move the trap doors to the closed position; and closing the first door causes the deployment means to move the trap doors to the open position.

BRIEF DESCRIPTION OF THE DRAWINGS

A better understanding of the present invention will be had with reference to the accompanying drawings in which.

DETAILED DESCRIPTION

Figure 1:
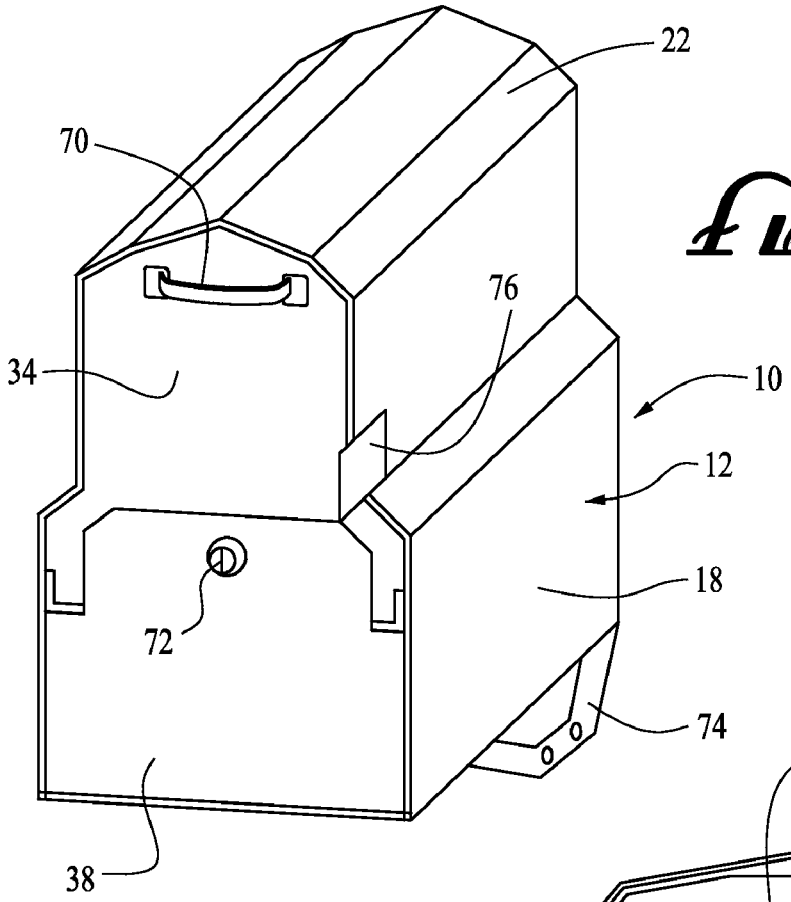
FIG. 1 is a front perspective view of a lockable container according to a first embodiment of the present invention.
Figure 4:
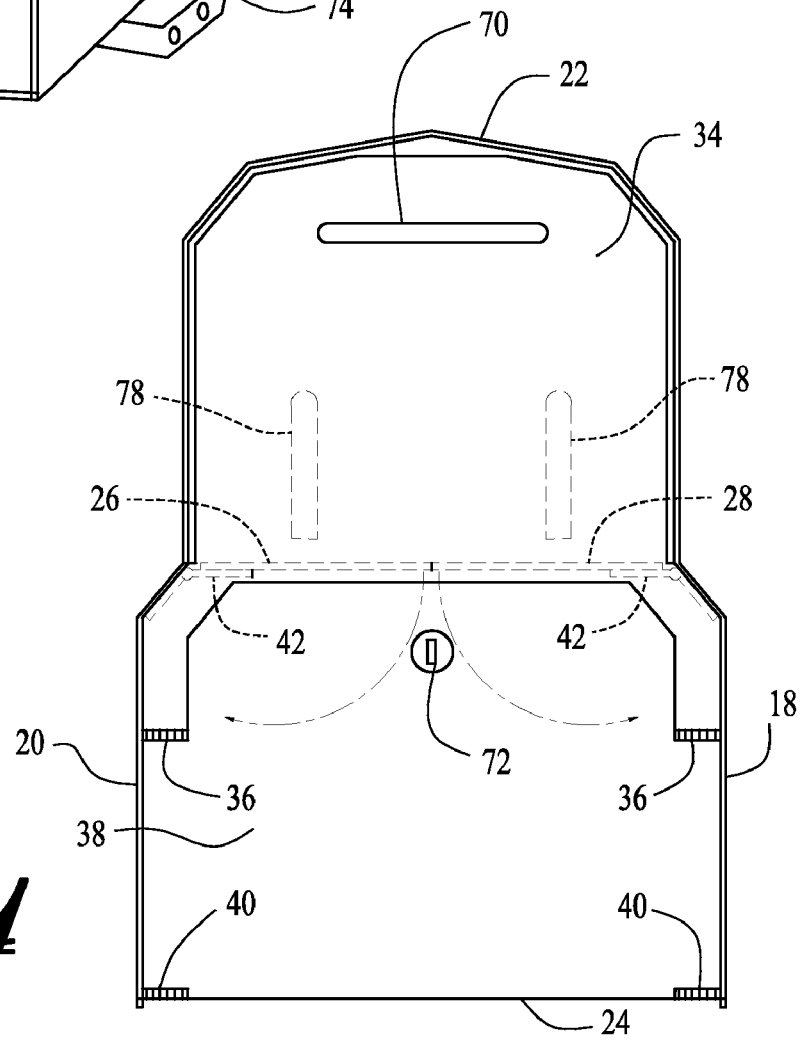
FIG. 4 is a partially transparent front elevation view of the lockable container of FIG. 1.
Figure 2A:
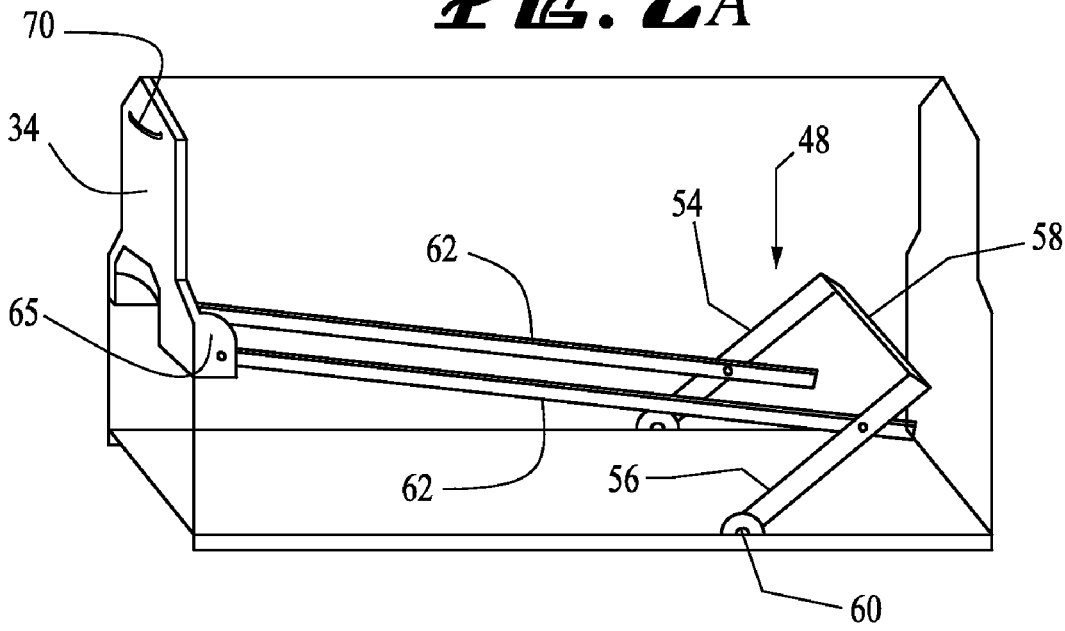
FIG. 2A is a partially cut away side elevation view of the lockable container of FIG. 1 showing the deployment means in an open position.
Figure 2B:
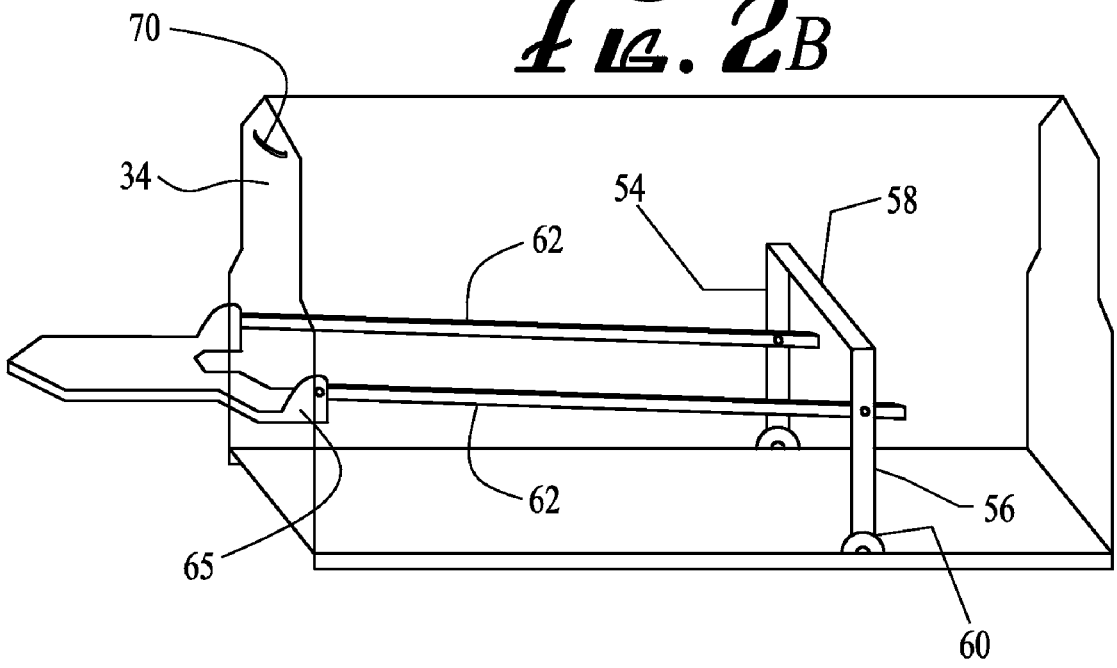
FIG. 2B is a partially cut away side elevation view of the lockable container of FIG. 1 showing the deployment means in a closed position.

A lockable container 10 according to a first embodiment the present invention is shown in FIGS. 1 to 7. The container 10 has a hollow housing 12. The housing 12 is typically formed with a front wall 14, a rear wall 16, two side walls 18, 20, a top 22 and a bottom 24. The housing 12 is divided by movable opposing trap doors 26, 28 to form a container having a first compartment 30 and a second compartment 32.

A first door 34 in the front wall 14 provides access to the first compartment 30. The first door 34 is rotatably coupled to the front wall 14, such as by hinges 36, and is reversibly movable between an open position and a closed position. A second door 38 in the front wall 14 provides access to the second compartment 32. The second door 38 is rotatably coupled to the front wall 14 or the bottom 24, such as by hinges 40.

Figure 3A:
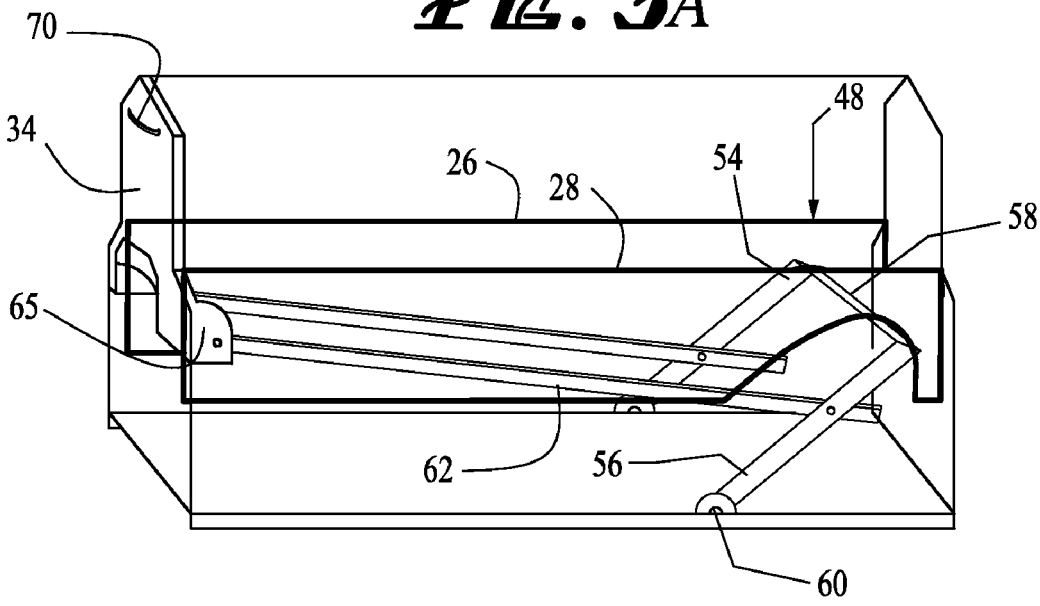
FIG. 3A is a is a partially cut away side elevation view of the lockable container of FIG. 1 showing the trap doors and deployment means in an open position.
Figure 3B:
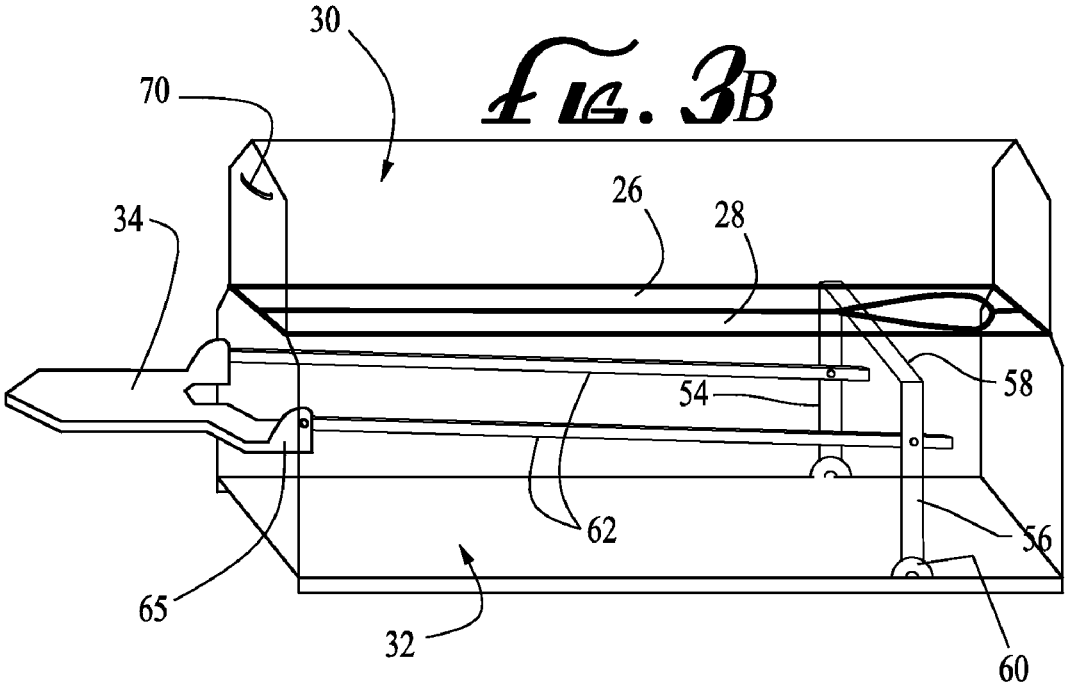
FIG. 3B is a is a partially cut away side elevation view of the lockable container of FIG. 1 showing the trap doors and deployment means in a closed position.

As shown in FIGS. 3A to 9, The trap doors 26, 28 are reversibly movable between an open position, as shown in FIG. 3A, wherein the first and second compartments are in communication, and a closed position, as shown in FIG. 3B, wherein the first compartment 30 is separated from the second compartment 32.

Figure 9:
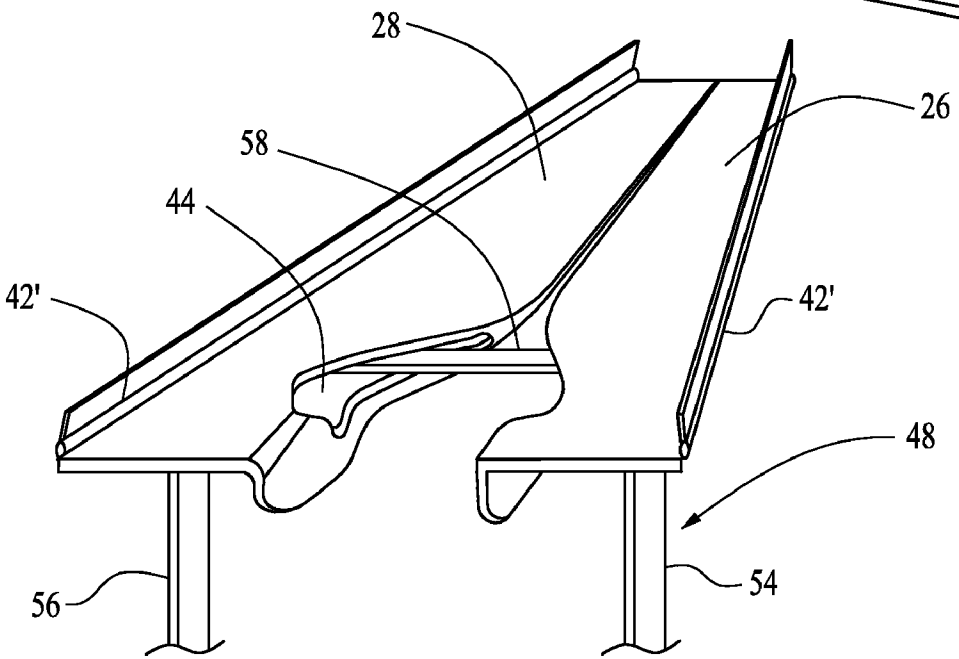
FIG. 9 is a perspective view of trap doors usable in the lockable container of FIG. 1.

Each of the trap doors 26, 28 is rotatably coupled to the housing 12. Preferably, each of the trap doors 26, 28 is coupled to a different one of the side walls 18, 20 by a plurality of hinges 42. Alternatively, as shown in FIG. 9, each of the trap doors 26, 28 is coupled to a different one of the side walls 18, 20 by a hinge 42' extending along the length of the trap door.

Each trap door has a slot 44 for placement of a deployment means 46 for opening and closing the trap doors. In a preferred embodiment of the present invention, the deployment means 46 includes a support bracket 48 that rides in the slot 44. Movement of the support bracket moves the trap doors 26, 28 to rotate around parallel horizontal axes from the open position to the closed position and vice versa. Preferably, when the housing 12 is substantially rectangular, the support bracket 48 is substantially U-shaped with two ends 50, 52, two sides 54, 56 and a central portion 58. Each end 50, 52 is rotatably coupled to a flange 60 on the inside of the housing 12 located on the side walls 18, 20 or the bottom 24.

A lever 62, having a first end 64 coupled to a leg 65 of the first door 34 and a second end 66 rotatably coupled to one of the sides 54, 56 of the support bracket, moves the bracket 48 upon movement of the first door 34 between the open and closed positions. Preferably, the first door 34 has two legs 65, each of which is coupled to a separate lever 62. Each of the levers 62 is coupled to a different side of the support bracket 48.

Figure 8:
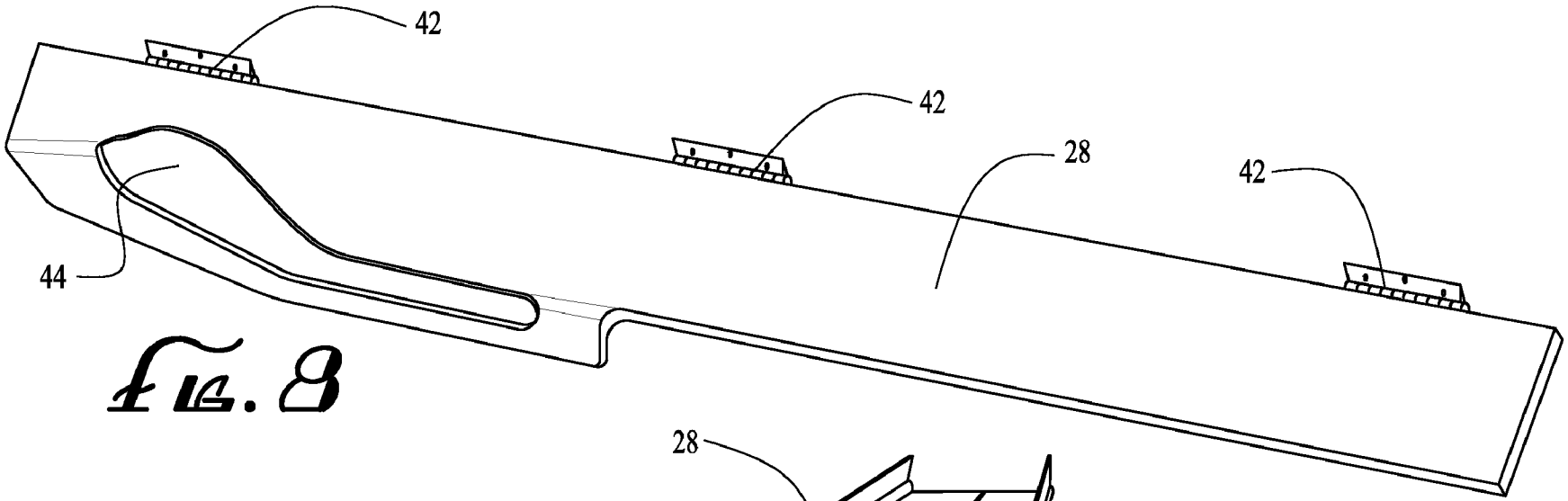
FIG. 8 is a side perspective view of a trap door usable in the lockable container of FIG. 1.

The support bracket 48 can be coupled to the flange and to the lever, and the lever can be coupled to the leg, using fasteners known in the art. For example, the fasteners may be pins with a washer and Cotter pin holding the pin in place. Preferably, as shown in FIGS. 8 and 9, each trap door has a bent portion and each slot 44 has a portion with an enlarged opening to prevent binding of the support bracket 48 upon movement of the trap doors and the bracket.

Opening the first door 34 forces the lever 62 to move the support bracket 48 along the slot 44 in the trap doors 26, 28 thereby forcing the trap doors 26, 28 to the closed position so mail can be deposited on the separator and held in the first compartment 30. Closing the first door 34 forces the lever 62 to move the bracket 48 back along the slot 44 in the trap doors 26, 28, thereby forcing the trap doors to the open position. Once the trap doors 26, 28 move to the open position, mail in the first compartment 30 falls down to the second compartment 32 where it remains until removed through the second door 38. When the first door 34 is reopened, the trap doors 26, 28 move to the closed position allowing the deposition of more mail, but preventing access to the items in the second compartment 32.

Once the items in the second compartment 32 become voluminous, such as when mail has not been removed for an extended period of time, the items in the second compartment 32 prevent the trap doors from moving from the open position to the closed position. Because the trap doors 26, 28 are coupled to the first door 34, blockage of the trap doors 26, 28 prevents the first door from opening. Thus, further deliveries are deterred until the second compartment 32 is emptied.

Figure 10:
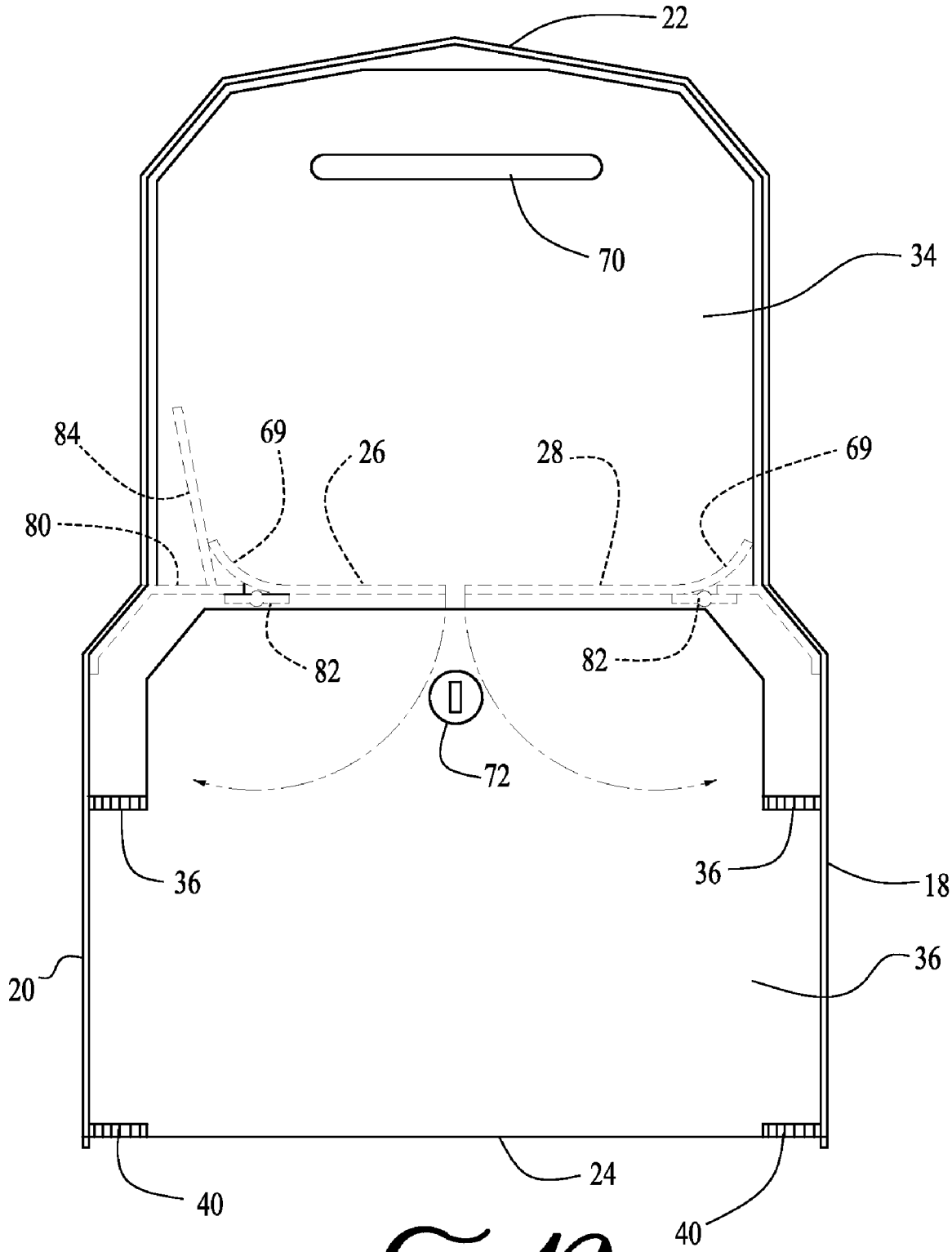
FIG. 10 is a partially transparent front elevation view of a lockable container according to a second embodiment of the present invention.

Preferably, at least one stop brace 68 is coupled to the inside of the front wall 14 or the rear wall 16 in a position to prevent the trap doors 26, 28 from being pried open by someone trying to gain access to the second compartment 32. Optionally, as shown in FIG. 10, the edges of the trap doors adjacent to the hinges have a rolled lip 69 such that when the doors reach the closed position, the lip 69 contacts the housing 12 to prevent the trap doors 26, 28 from being pried open by someone trying to gain access to the second compartment 30. Additionally, as the trap doors move to the open position, the rolled lip 69 pushes mail on the sides toward the center of the container, and down through the trap doors.

Figure 7:
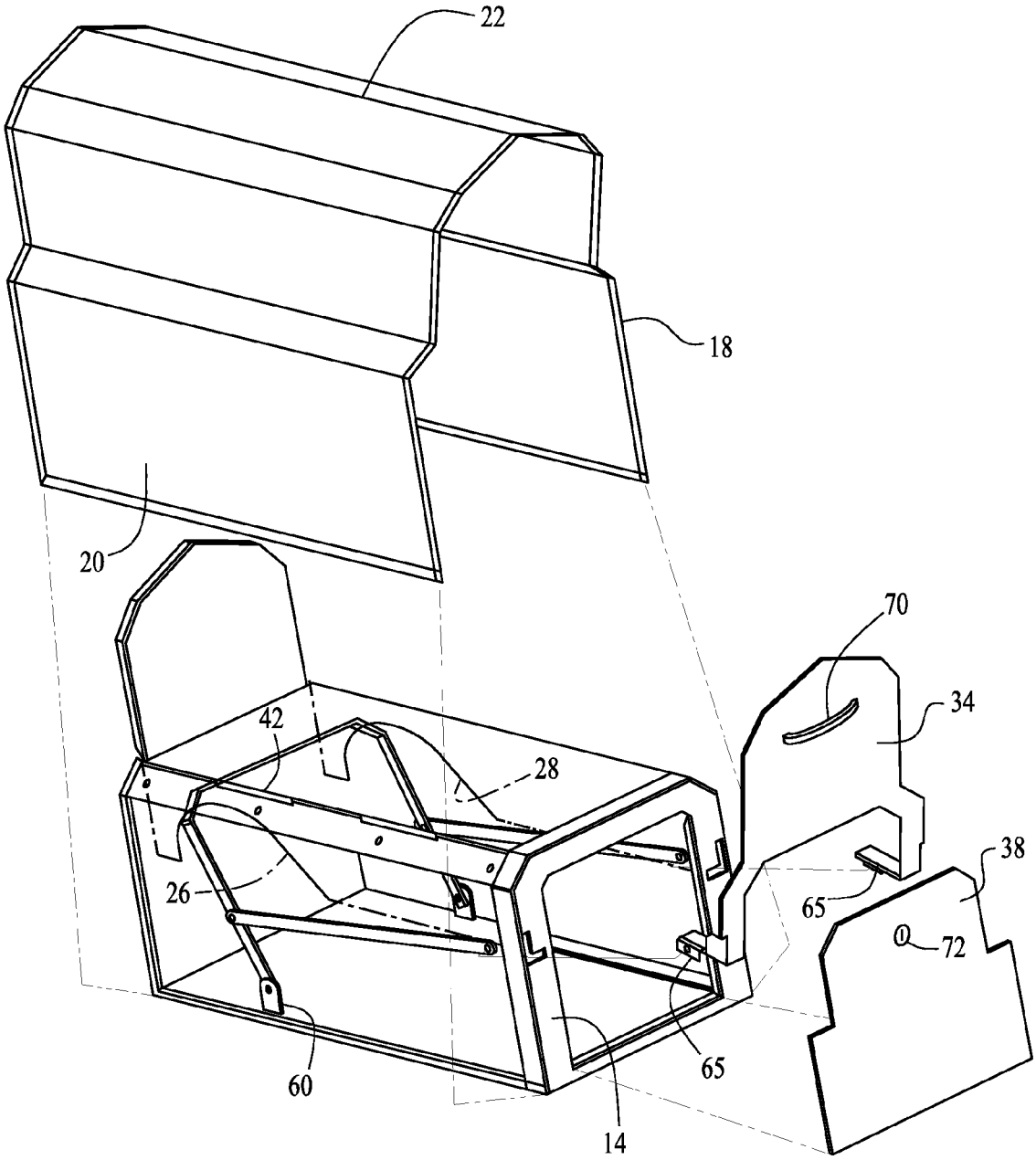
FIG. 7 is an exploded front perspective view of the lockable container of FIG. 1.

The housing 12, the first door 34 and the second door 38 can be made in any shape desired for aesthetic purposes, as well as to conform to any applicable postal guidelines. Additionally, as shown in FIG. 7. the housing 12 can be made from a plurality of different segments that are joined together or of a unitary construction. Additionally, the orientation of the first door 34, the second door 38, and the deployment means 46 can be altered to allow for the first and second doors to be on different sides of the container.

Figure 5:
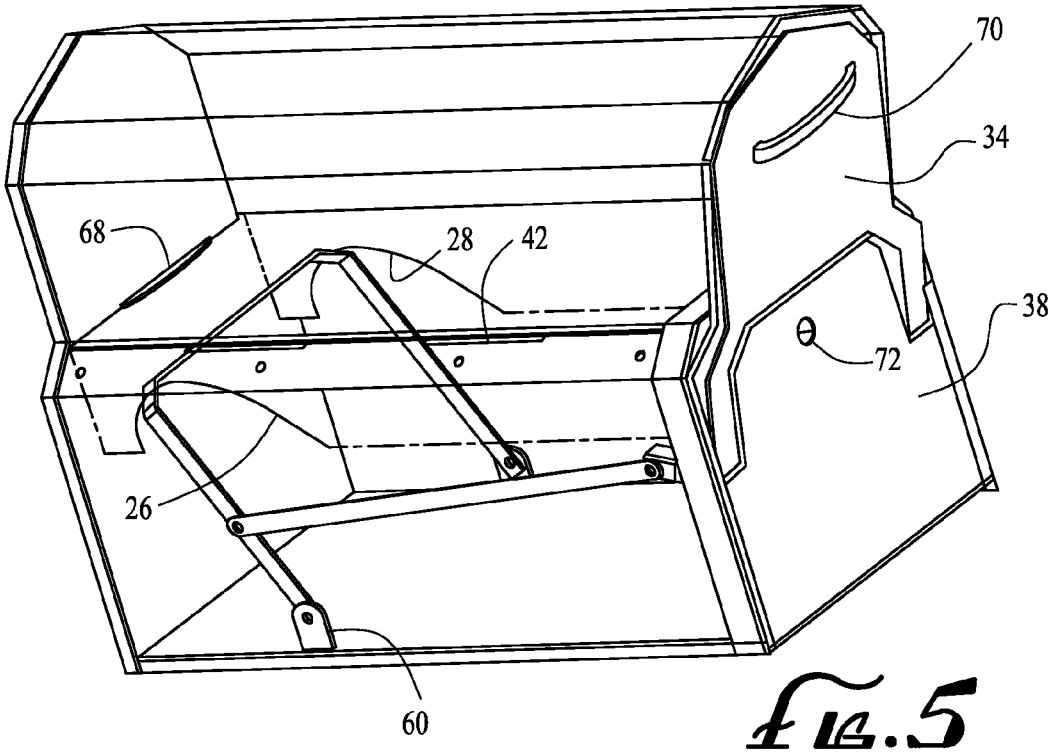
FIG. 5 is a partially transparent front perspective view of the lockable container of FIG. 1 showing the position of the trap doors in the closed position.
Figure 6:
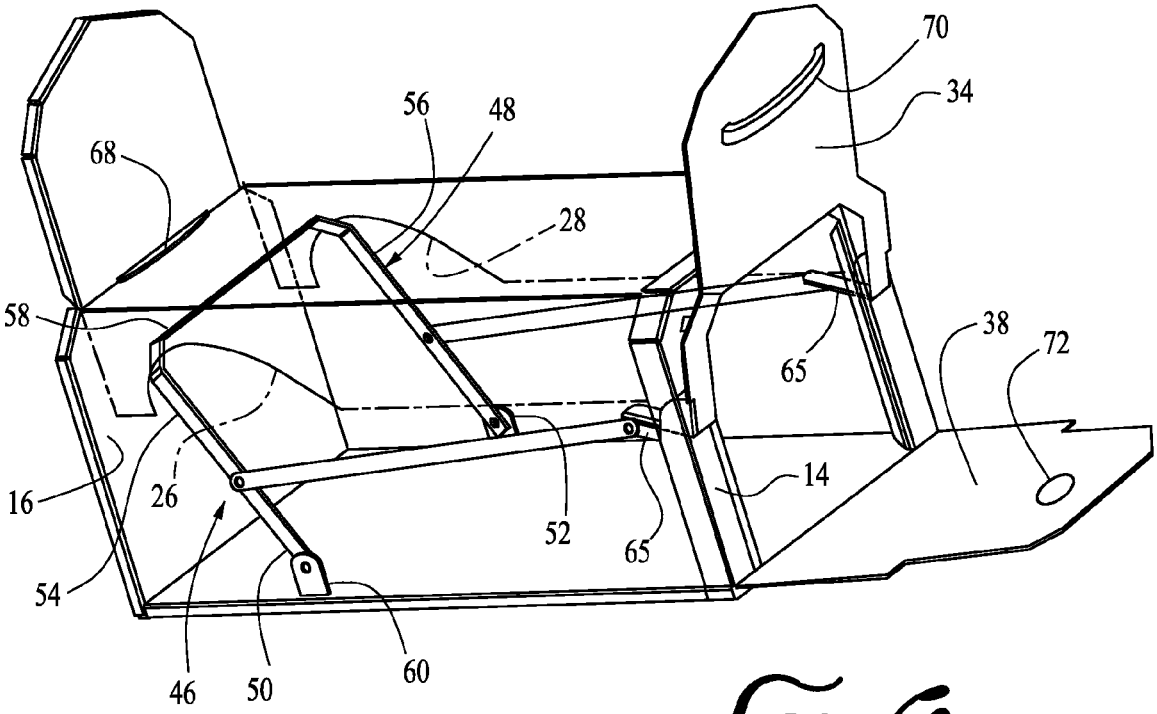
FIG. 6 is a partially transparent front perspective view of the lockable container of FIG. 1 showing the position of the deployment means in the closed position.

The housing 12, first door 34, second door 38 and trap doors 26, 28 may be made of any durable, easy to form material such as stamped sheet metal or molded plastics. It is important that the housing 12 be tamper resistant. Preferably, the housing 12 is weather resistant and substantially impermeable to rain and snow to protect the contents inside. Preferably, the top 22 of the housing 12 is peaked to allow for snow and rain to drain off of the top of the container. Additionally, as shown in FIG. 5, the top 22 may extend outward beyond the first and second doors to prevent moisture from reaching the door openings.

As shown in FIG. 1, the housing is preferably shaped to have a slightly larger second compartment. A slightly larger second compartment allows the deployment means 26 to be out of the way of the contents, and allows at least the full volume of the first compartment to be storable in the lower section.

The first door 34 is unlocked to provide a mail deliverer access to the container to deposit mail and retrieve outgoing mail. Preferably, the first door 34 has a handle 70 to allow for easy access by a mail carrier. The second door 38 has a lock 72 that releasably secures the second door 38 to the housing 12 to prevent unauthorized access to the second compartment 32. Preferably, the lock 72 is opened with a key, although, the lower door lock can be a combination lock. Additionally, the lock 72 can utilize a proximity sensor or a biometric device. Preferably, the lock 72 functions as a handle. However, the second door 36 can also have a handle (not shown) for convenience.

Preferably, as shown in FIG. 1, the container further comprises a brace 74 for coupling the container to a post, pole or other support structure. The brace can have a plurality of holes for use of fasteners, such as screws or nails to hold the brace to the support structure. Additionally, the bottom 24 may have at least one flange (not shown) for mounting the container on a post.

Additionally, as shown in FIG. 1, an indicator 76 can be mounted on the housing 12. The indicator 76 is movable between a raised position, to indicate the presence of outgoing mail, and a lowered position. For placement of outgoing mail in the mailbox where it will not fall through the trap doors 26, 28, clips 78 are coupled to the inside of the housing in the first compartment, such as on an inside of the first door 32. This is advantageous because outgoing mail stored outside of the mailbox is subject to theft and tampering, and to the weather.

In an additional embodiment of the present invention, shown in FIG. 10, at least one of the side walls 18, 20 has a shelf 80 on an inside surface thereof. Instead of being rotatably coupled to one of the side walls, one of the trap doors is rotatably coupled to the shelf 80, such as by hinges 82. Preferably, the shelf 80 has a flange 84, such that the housing 12, shelf 80 and flange 84 form an outgoing mail pocket. Items placed in the outgoing mail pocket are prevented from passing through the trap doors 26, 28 when the trap doors are moved to the open position.

Although the present invention has been described in considerable detail with reference to certain preferred versions thereof, other versions are possible. Therefore, the spirit and scope of the appended claims should not be limited to the description of the preferred versions described herein.

All features disclosed in the specification, including the claims, abstracts and drawings, and all the steps in any method or process disclosed, may be combined in any combination except combination where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

As used herein, the term "coupled" means connected, such as with a fastener, connector, adhesive, or weld, and also includes structures that are integrally formed.

Any element in a claim that does not explicitly state "means" for performing a specified function or "step" for performing a specified function, should not be interpreted as a "means" or "step" clause as specified in 35 U.S.C. §112.

What is claimed is:

1. A securable mailbox comprising:

a. a hollow housing having a front wall, a back wall, side walls, a top and a bottom for defining a first compartment and a second compartment;

b. a first door rotatably connected to the housing and providing access to the first compartment, the first door being reversibly movable between an open position and a closed position;

c. a second door rotatably connected to the housing and providing access to the second compartment, the second door being lockable to the housing;

d. two opposing trap doors for dividing the first compartment from the second compartment, each trap door being rotatably coupled to one of the side walls of the housing; and e. a deployment means for moving the trap doors between a closed position in which the first compartment is separated from the second compartment and an open position in which the first compartment is in communication with the second compartment;

wherein:

opening the first door forces the deployment means to move the trap doors to the closed position; and closing the first door forces the deployment means to move the trap doors to the open position;

the trap doors each have a slot;

the deployment means comprises:

i. a lever rotatably coupled to the first door; and ii. a support bracket rotatably coupled to the lever and rotatably coupled to at least one of the side walls or the bottom, at least a portion of the bracket being positioned in the slots of the trap doors; and wherein the slots are configured such that movement of the support bracket along the slots causes the trap doors to be reversibly moveable from the open position to the closed position.

2. The mailbox of claim 1 further comprising a stop coupled to the front wall or the rear wall to limit the range of movement of the trap doors.

3. The mailbox of claim 1 wherein the second door has at least one of the group consisting of a key lock and a combination lock.

4. The mailbox of claim 1 further comprising an indicator for indicating the presence of outgoing mail in the mailbox.

5. The mailbox of claim 1 further comprising at least one clip on an inside of the first door for holding outgoing mail.

6. The mailbox of claim 1 further comprising a brace for attaching the mailbox to a support structure, the brace being coupled to the housing.

7. The mailbox of claim 1 wherein the top is peaked and extends beyond the front wall.

8. A securable mailbox comprising:

a. a hollow housing having a front wall, a back wall, side walls, a top and a bottom for defining a first compartment and a second compartment;

b. a first door rotatably connected to the housing and providing access to the first compartment, the first door being reversibly movable between an open position and a closed position;

c. a second door rotatably connected to the housing and providing access to the second compartment, the second door being lockable to the housing;

d. an outgoing mail pocket extending horizontally along one of the side walls;

e. a first trap door rotatably coupled to the outgoing mail pocket;

f. a second trap door rotatably coupled to the side wall opposite the outgoing mail pocket; and g. a deployment means for moving the first and second trap doors between a closed position in which the first compartment is separated from the second compartment and an open position in which the first compartment is in communication with the second compartment;

wherein opening the first door forces the deployment means to move the trap doors to the closed position; and closing the first door forces the deployment means to move the trap doors to the open position.

9. The mailbox of claim 8 wherein:

a. the trap doors each have a slot;

b. the deployment means comprises:

i. a lever rotatably coupled to the first door; and ii. a support bracket rotatably coupled to the lever and rotatably coupled to at least one of the side walls or the bottom, at least a portion of the bracket being positioned in the slots of the trap doors;

wherein the slots are configured such that movement of the support bracket along the slots causes the trap doors to be reversibly moveable from the open position to the closed position.

10. The mailbox of claim 9 further comprising a stop coupled to the front wall or the rear wall to limit the range of movement of the trap doors.

11. The mailbox of claim 10 wherein the trap door comprise rounded edges that contact the side walls when the trap doors reach the closed position to limit the range of movement of the trap doors.

12. The mailbox of claim 8 further comprising an indicator for indicating the presence of outgoing mail in the mailbox.

13. The mailbox of claim 8 wherein the second compartment is larger than the first compartment and is sized such that the entire volume of the first compartment can fit in the second compartment without contacting the deployment means.

14. A securable mailbox comprising:

a. a hollow housing defining a first compartment and a second compartment;

b. a first door rotatably connected to the housing and providing access to the first compartment, the first door being reversibly movable between an open position and a closed position;

c. a second door rotatably connected to the housing and providing access to the second compartment, the second door being lockable to the housing;

d. two opposing trap doors for dividing the first compartment from the second compartment, each trap door being rotatably coupled to an inside of the housing; and e. a deployment means for moving the trap doors between a closed position in which the first compartment is separated from the second compartment and an open position in which the first compartment is in communication with the second compartment;

wherein:

opening the first door causes the deployment means to move the trap doors to the closed position; and closing the first door causes the deployment means to move the trap doors to the open position;

the trap doors each have a slot:

the deployment means comprises:

i. a lever rotatably coupled to the first door; and ii. a support bracket rotatably coupled to the lever and rotatably coupled to the inside of the housing, at least a portion of the bracket being positioned in the slots of the trap doors; and wherein the slots are configured such that movement of the support bracket along the slots causes the trap doors to be reversibly moveable from the open position to the closed position.

15. The mailbox of claim 14 further comprising a stop coupled to the inside of the housing to limit the range of movement of the trap doors.

16. The mailbox of claim 14 further comprising an indicator for indicating the presence of outgoing mail in the mailbox.

17. The mailbox of claim 14 wherein the second door has at least one of the group consisting of a key lock and a combination lock.

* * * * *